US007426807B2

(12) United States Patent
Cadwell et al.

(10) Patent No.: US 7,426,807 B2
(45) Date of Patent: Sep. 23, 2008

(54) COMPOSITE TELEPHONE POLE

(76) Inventors: Charles E Cadwell, 157 Paramount Dr., Wood Dale, IL (US) 60191; Carl Fischer, 20054 Regina Rd., New Paris, IN (US) 46553

( * ) Notice: Subject to any disclaimer, the term of this patent is extended or adjusted under 35 U.S.C. 154(b) by 375 days.

(21) Appl. No.: 10/792,102

(22) Filed: Mar. 3, 2004

(65) Prior Publication Data

US 2005/0223673 A1 Oct. 13, 2005

(51) Int. Cl.
*E04C 3/34* (2006.01)

(52) U.S. Cl. ..... 52/723.1; 52/721.4; 52/726.4; 52/736.3; 52/737.4; 52/738.1

(58) Field of Classification Search ..... 52/721.4, 52/723.1, 726.4, 736.3, 737.4, 738.1, 40; 174/45 R; 138/112, 113, 175
See application file for complete search history.

(56) References Cited

U.S. PATENT DOCUMENTS

| | | | | |
|---|---|---|---|---|
| 3,181,849 | A * | 5/1965 | Mitchell | 257/140 |
| 4,166,347 | A | 9/1979 | Pohlman et al. | |
| 4,803,819 | A | 2/1989 | Kelsey | |
| 5,339,594 | A | 8/1994 | Ventura-Berti | |
| 5,513,477 | A * | 5/1996 | Farber | 52/726.4 |
| 5,611,373 | A * | 3/1997 | Ashcraft | 138/113 |
| 5,675,956 | A | 10/1997 | Nevin | |
| 5,800,889 | A | 9/1998 | Greene | |
| 6,123,485 | A | 9/2000 | Mirmiran et al. | |
| 6,179,215 | B1 | 1/2001 | Shea | |
| 6,322,863 | B1 | 11/2001 | Kubicky | |
| 6,409,433 | B1 * | 6/2002 | Hubbell et al. | 405/250 |
| 6,434,906 | B1 | 8/2002 | Jernstrom | |
| 6,453,635 | B1 | 9/2002 | Turner | |
| 7,186,449 | B1 * | 3/2007 | Hansen | 428/36.91 |
| 2002/0147255 | A1 | 10/2002 | Kubicky et al. | |
| 2002/0177663 | A1 * | 11/2002 | Cahill | 525/177 |

FOREIGN PATENT DOCUMENTS

| | | |
|---|---|---|
| EP | 0519680 | 12/1992 |
| EP | 0602055 B | 6/1994 |
| WO | WO 03054321 | 7/2003 |

OTHER PUBLICATIONS

Jay Feldman, M.A. and Greg Kidd, J.D., M.S., Pole Pollution, Beyond Pesticides, National Coalition Against the Misuse of Pesticides, Washington, DC2001, Dec. 1999.
Jay Feldman, M.A. and Terry Shistar, Ph.D., Poison Poles, National Coalition Against the Misuse of Pesticides, Washington, DC2001, 1997, pp. 1-49.
Atul Mittal and Soumitra Biswas, Pultrusion of Composites-An Overview, Oct. 9, 2003, Printout from Website, Original Date Unknown.

* cited by examiner

*Primary Examiner*—Richard E. Chilcot
*Assistant Examiner*—Jessica Laux
(74) *Attorney, Agent, or Firm*—Baker & Daniels LLP

(57) ABSTRACT

A composite utility pole or the like is shown, having an elongate member, where a deformable material is co-extruded over the outer surface. The elongate member can have any configuration, but is shown as a circular cross section, and can have structural ribs. Concrete fills the substantial portion of the pole to give it rigidity.

20 Claims, 5 Drawing Sheets

390
304
$x_2$
$x_1$
386
384
382
2

370
372
6
4

COMPOSITE TELEPHONE POLE

BACKGROUND OF THE INVENTION

The invention relates to a composite, preservative-free utility pole, such as a light or telephone pole.

It is reported that the chemicals used as wood preservatives are known to be hazardous pesticides, yet are continuously used for wood utility poles. It is estimated that 135,000,000 such poles are in use in the United States. See "Poison Poles" 1997 Report by the National Coalition Against the Misuse of Pesticides (NCAMP). In another NCAMP report, "Pole Pollution," a 1999 report, it is reported that pentachlorophenol, or "penta," is a known carcinogen, but is still used in the U.S. for chemically treated wood utility poles. At the same time, penta is banned in 26 other countries.

For this reason, composite utility poles have been suggested in the prior art. For example, in Farber, U.S. Pat. No. 5,513,477, premolded external segments are suggested, which are combined in modular fashion for on-site assembly. Mirmiran et al. shows in U.S. Pat. No. 6,123,485, a fiber-reinforced plastic exterior shell with a concrete filling. Kubicky suggests in U.S. Pat. No. 6,322,863, a utility pole with internal reinforcing rods and a pipe column, where the utility pole is comprised of scrap rubber emulsion dispensed in a steel plate casing. Jernstrom suggests in U.S. Pat. No. 6,434,906, a post defined as a hollow, two-layer pole having an inner layer of fiber-reinforced thermo set plastic and an outer layer of polyolefin plastic. U.S. Pat. Nos. 6,397,545 and 6,453,635 also show extruded or "pultruded" utility poles and methods of making the same. These references are incorporated herein by reference.

As such, designs do not provide an adequate replacement for the wooden utility poles, preservative-based wooden poles continue to exist, and continue to be manufactured for use in the United States. Wooden poles have certain characteristics which require duplication, if a composite pole is to replace it. Thus, a composite pole would need to be easily manufactured, cost competitive with wooden poles, easily stored and transported, and provide similar characteristics when in use. For example, it is also desirable that the poles have an exterior surface allowing a utility worker to scale the pole for installation and maintenance of overhead wires. At the same time, it would be beneficial if the composite poles provided some benefits which were not available in the wooden poles.

SUMMARY OF THE INVENTION

The objects have been accomplished by providing an elongate composite pole, or the like, comprising a structural elongate member having an outer tubular member, defining an elongate closed area. A strengthening material substantially fills the elongate closed area; and an outer casing, comprised of a deformable composite material, is deposited on the outside of the outer tubular member.

The structural elongate member further comprises an inner web of strengthening members, defining a plurality of elongate closed columnar areas. The outer tubular member is preferably cylindrical. The strengthening members are defined as radially extending ribs. The structural elongate member is comprised of two substantially concentric cylindrical members interconnected by the radially extending fins. The volume within an inner one of the two substantially concentric cylindrical members is left unfilled for a wiring passageway. The elongate strengthening material is preferably concrete.

The radially extending ribs of the structural elongate member are connected at their diametrical center, forming three substantially equal sectors. The elongate composite pole may have all of the sectors filled with the strengthening material. The strengthening material is preferably concrete. The outer casing is comprised of a composite material of 40%-60% by volume polyethylene and 60%-40% by volume ground rubber particles.

In another embodiment of the invention, an elongate composite pole, or the like, comprises a structural elongate member having an outer tubular member, and an inner web of strengthening members defining a plurality of elongate closed columnar areas. A strengthening material substantially fills at least some of the closed columnar areas; and an outer casing is deposited on the outside of the outer tubular member.

The outer tubular member is cylindrical, and the strengthening members are defined as radially extending ribs. The structural elongate member is comprised of two substantially concentric cylindrical members interconnected by, the radially extending fins. The volume within an inner one of the two substantially concentric cylindrical members is left unfilled for a wiring passageway. The strengthening material is concrete.

Alternatively, the radially extending ribs of the structural elongate member can be connected at their diametrical center, forming three substantially equal sectors. The elongate composite pole can have all of the sectors filled with the strengthening material. The strengthening material can be concrete. The outer casing is comprised of a deformable composite material comprised of a composite material of 40%-60% by volume polyethylene and 60%-40% by volume ground rubber particles.

In an inventive method of forming an elongate composite pole, the following steps are performed: a structural elongate member is provided having an outer tubular member defining an elongate closed area; an outer casing is deposited on the outside of the inner tubular member, the outer casing comprised of a deformable composite material; and subsequently, filling the elongate closed area with a strengthening material.

The structural elongate member is formed with the process of pultrusion. The structural elongate member is formed from strengthening fibers and a thermo-set resin. The outer casing is co-extruded over said structural elongate member.

The structural elongate member is manufactured according to the process of pultrusion, to comprise an inner web of strengthening members, defining a plurality of elongate closed columnar areas, at least some of the closed columnar areas filled with the strengthening material. The outer casing is thereafter co-extruded over the structural elongate member to complete the assembly.

DETAILED DESCRIPTION OF THE EMBODIMENT

Figure 1:
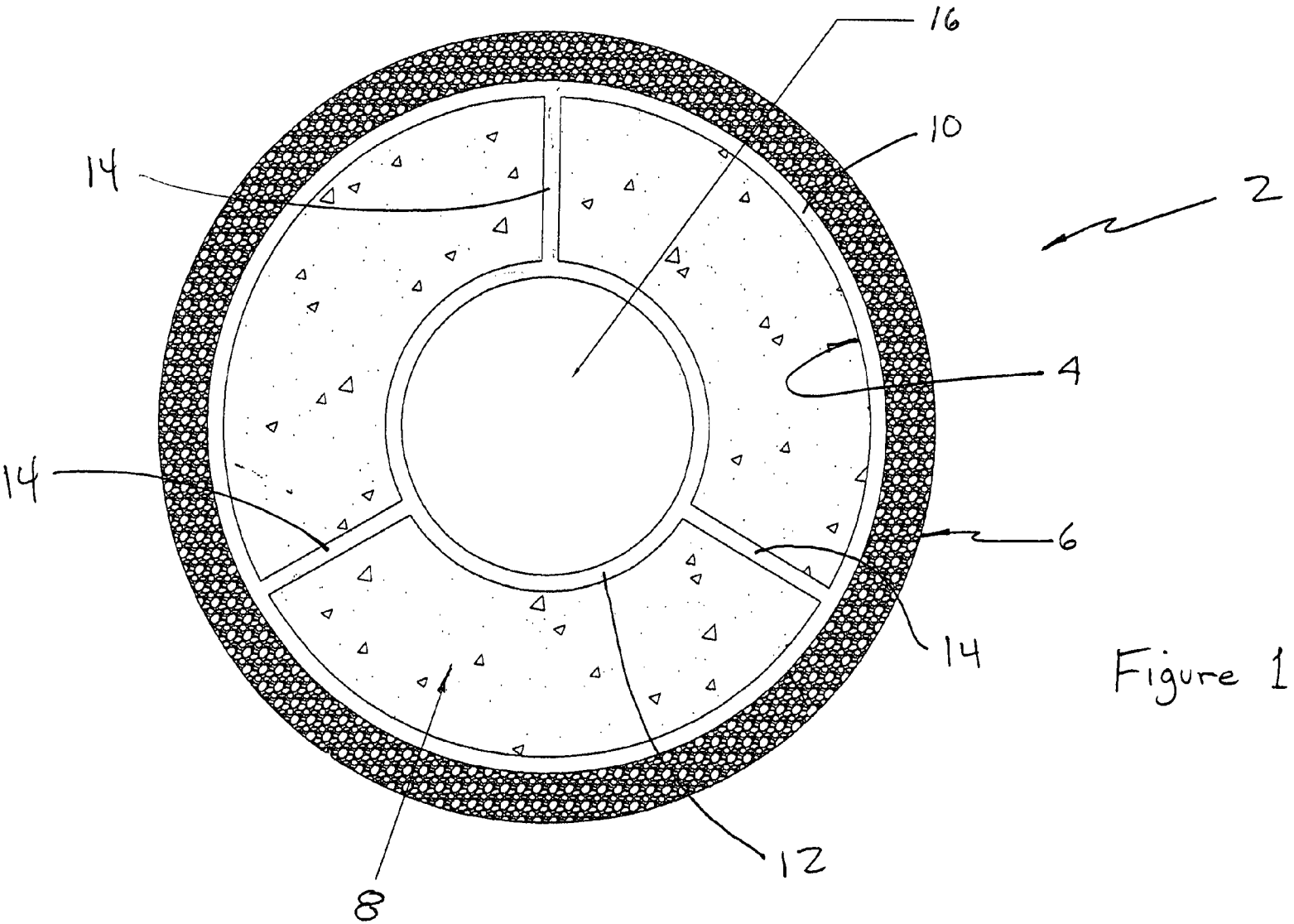
FIG. 1 shows a cross-sectional view of one version of the composite pole according to the invention.

With reference first to FIG. 1, the composite tubular member is shown in cross section generally at 2, to include a structural elongate member 4 having an outer deformable composite material deposited thereon, shown best at 6 and, a strengthening material filling at least a substantial portion of the structural elongate member, shown at 8.

With reference still to FIG. 1, the structural elongate member 4 includes an outer tubular member at 10, an inner tubular member at 12, where the inner and outer tubular members are disposed substantially concentrically, and are held together by radially extending ribs 14. Thus, the structurally elongate member defines three ring-shaped volumes, defined within the confines of the inner and outer tubular members 12, 10 and intermediate the ribs 14, together with an inner volume 16 defined within the inner tubular member 12.

In the embodiment shown in FIG. 1, the three ring-shaped portions are filled with the strengthening material 8, which is concrete, while the volume 16 is left unfilled and can be used as a passageway for wires for a utility pole or other such passageway. Also, the outer composite material 6 is comprised of a combination of recycled plastic and crumb rubber, as will be described herein.

Figure 2:
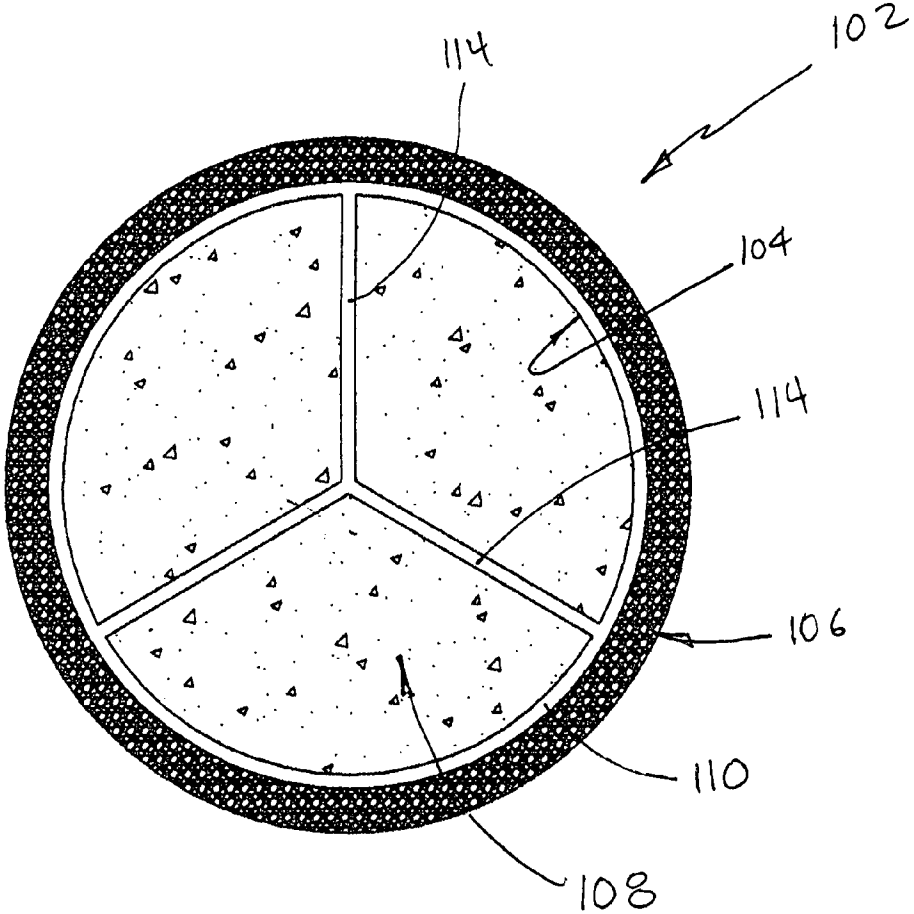
FIG. 2 shows another version of the composite telephone pole according to the invention.

With respect now to FIG. 2, another embodiment of the elongate pole will be shown to include an inner structural member at 104 having an outer tubular member 110, where three radially extending ribs 114 extend inwardly from the outer tubular member 110 and join at a diametric center. This defines three substantially equal sector-shaped sections and in the embodiment shown in FIG. 2, all three sections are filled with concrete. However, it should be appreciated that, while three ribs 114 are shown, any number of ribs could be positioned in a radially extending manner, and some of the inner volumes could be left unfilled to define an elongate passageway, similar to that described above with reference to inner volume 16.

Figure 3:
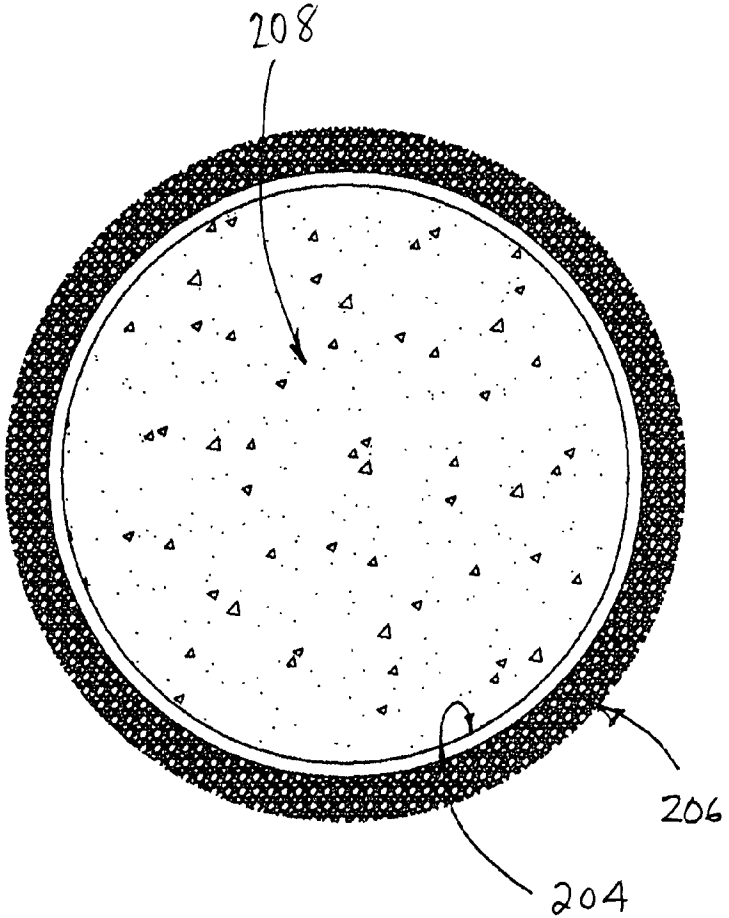
FIG. 3 shows yet another embodiment of the invention.

As shown in FIGS. 1-3, any of the elongate structural members 4, 104, 204 are easily manufactured from a pultrusion process, and therefore could take on virtually any configuration. The elongate structural members 4, 104, 204 could be make from any material which would give it sufficient columnar strength, such as aluminum, NYLON, ceramics or thermo set plastics. However, the process will be described herein as being comprised from a thermo-set resin and elongate strengthening fibers, where the elongate structural fibers are embedded into the thermo-set plastic or resin during the molding process. This molding process is commonly referred to as "Pultrusion" in the art. See for example, the January 2000 publication "Pultrusion of Composites-An Overview" by Atul Mittel and Soumitra Biswas, at their website www.tifac.org.in, which is incorporated herein by reference.

The outer deformable material 6, 106, 206 will be described hereinafter, is a mixture of recycled plastic and crumb rubber. This material withstands weathering, but is sufficiently deformable to permit the spikes of a utility worker to ascend the pole. The outer casing 6, 106, 206 is a 50-50 mixture of high-density polyethylene and crumb rubber. Preferably, the high-density polyethylene is obtained from recycled plastics, such as found in plastic shampoo or detergent bottles, etc., that have been shredded as is known in the industry. The rubber particles are preferably "crumb" rubber articles obtained from recycled automotive tires that have been ground and sized as is known in the art. The size of the rubber particles is preferably between "ten" and "forty mesh" according to standard industry sizing methods. Rubber particles may include approximately 1% or less by volume long strand nylon fibers, which are commonly found in ground tires. As discussed above, the rubber particles provide a semi-resilient quality to the plastic, thus preventing the plastic from cracking. The mixture may be varied to contain as much as 60% shredded high-density polyethylene and 40% crumb rubber to 40% shredded high-density polyethylene and 60% crumb rubber. It should be understood however, that other filler materials could be used such as wood flour, fiber reinforcement, talc filled, sugar beet pulp, or other similar fillers.

The details of the composite material are given by the following example. A quantity of used polyethylene bottles from various sources is ground in a shredder, which produces non-uniform plastic particles of approximately one-half inch square, and of varying shapes and thicknesses. A quantity of used automobiles tires is ground into crumb rubber particles using any commercially available grinding method. Using a 10-40 mesh screen, the crumb rubber is sized to produce 10-40 mesh rubber particles. Typically, the 10-40 mesh crumb rubber will include approximately 1% by volume long strand nylon fibers from the reinforcing belts found in most tires. The crumb rubber particles and the shredded plastics are combined into a 50-50 mixture by volume.

The composite material may be prepared by using a Compact Compounder having a long continuous mixer and a singe screw extruder, such as is manufactured by Pomini, Inc. of Brecksville, Ohio. The shredded polyethylene is placed in the first supply hopper of the co-extruder, and the crumb rubber particles are placed in a second supply hopper. The shredded plastic and the rubber particles are introduced into the barrel and brought to a molten state under pressure by the friction of the counter-rotating rotors. The melted mix is then fed into a single screw extruder, forced forward through the barrel by a supply screw.

Minor departures from the 50-50 ratio can be achieved without significantly reducing the beneficial properties of the final product. This variation can be especially useful when the weight or density of the final product needs to be tightly controlled. The natural gray/black color of the plastic/rubber matrix will be suitable for most applications. However, a small amount of colorant can be added in order to produce a different colored member. For example, red dye can be added in order to produce a simulated wood member, and will give the appearance of cedar or redwood depending on the amount of dye added. A detailed description of the process will now be described with reference to FIGS. 4A-4C.

Figure 4A:
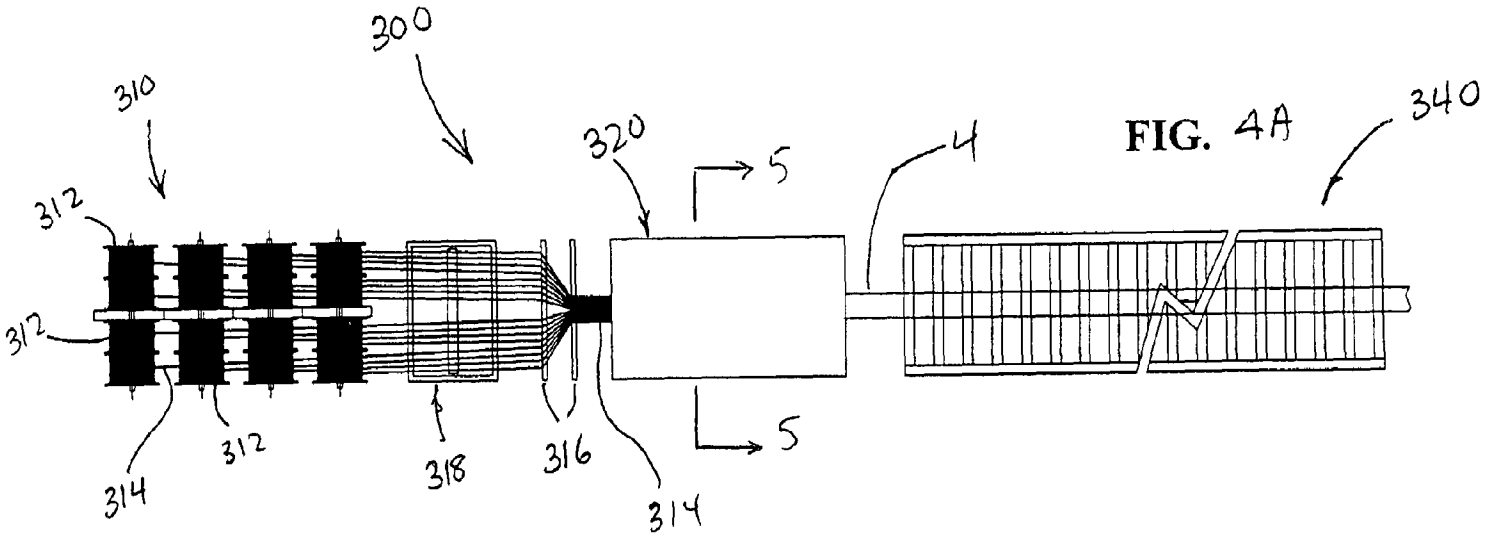
FIG. 4A-4C shows the process steps of the pultrusion of the structural member, as well as the co-extrusion of the compound for the outer deformable material.
Figure 4B:
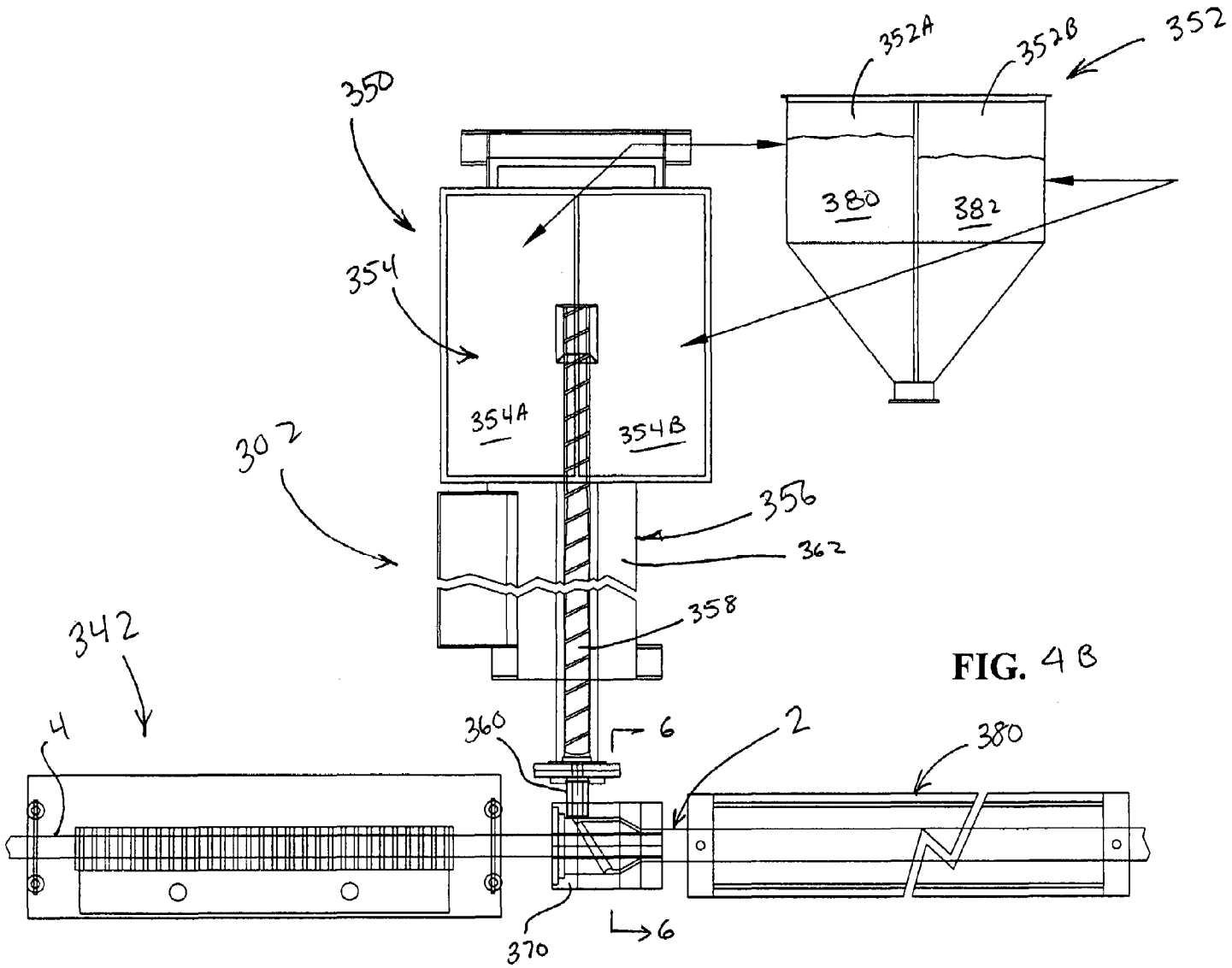
Figures 4C, 6:
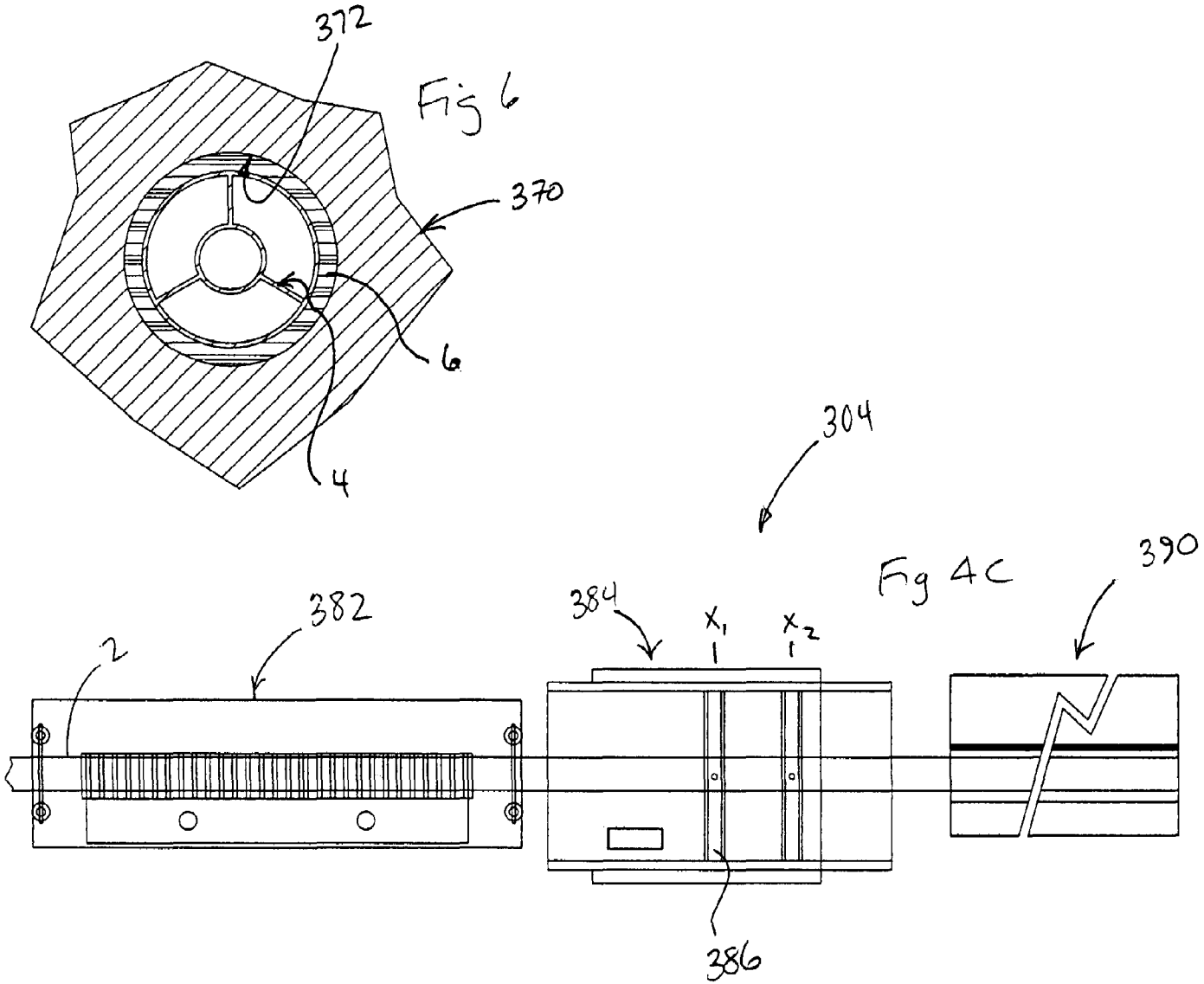
FIG. 6 is a cross-sectional view through lines 6-6 of FIG. 4B.

FIGS. 4A-4C diagrammatically illustrate the process. With respect to FIGS. 4A-4C, the process generally includes three stations, a pultrusion process station 300, a co-extrusion process station 302, and a finish station 304. The pultrusion station 300 will form one of the elongate members 4, 104, 204, although in this diagrammatical description, the process will be described with reference to the manufacturing of structural member 4 and finished component 2. The co-extrusion station 302, is shown generally in FIG. 4B, and co-extrudes the outer deformable material 6 onto the outer diameter of the structural member 4. Finally, as shown in FIG. 4C, the finishing station 304 prepares the process length of finished product into discrete lengths for use. It should also be appreciated with reference to FIGS. 4A-4C, that the process is continuous, that is, the process moves from left to right as viewed in FIG. 4A, and the product would be received on the left side of FIG. 4B, and the product would be received onto the left side of FIG. 4C and moved from left to right to complete the process.

Figure 5:
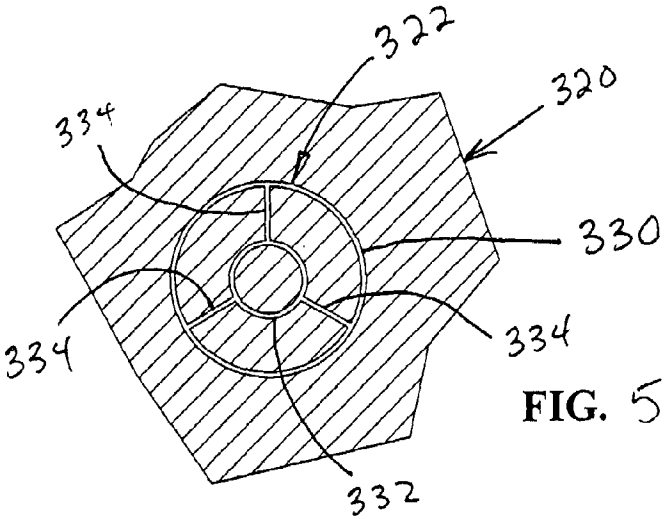
FIG. 5 is a cross-sectional view through lines 5-5 of FIG. 4A.

With reference now again to FIG. 4A, the pultrusion process is generally defined by a fiber creel shown generally at 310, which includes a plurality of spools 312, where each spool feeds a fiber 314 through preformed plates 316 passing through a resin bath 318. It should be appreciated that the fibers passing through the resin bath 318, due to the capillary attraction of the resin to the fiber, would pick up the liquid resin and carry it with it through the plates 316 into a heated die 320. Heated die 320 has a forming cavity 322 of identical cross-section as the structural member 4 to be defined. In particular, heated die 320 includes a cavity 322, as shown in FIG. 5, having an outer circular cavity portion 330 matching the diameter of outer diameter portion 10, and inner diameter portion 332 matching the inner diameter 12 and radial rib portions 334 profiled to defined radial ribs 14. It should be understood that fibers 314 are fed into cavity 322, such that various portions fill each of the cavity portions 330, 332 and 334, such that when the wetted fibers are thermo-set by the heated die 320, the completed structural member 4 is produced at the opposite end. Structural component 4 is then received onto a cooling rack 340, where the thermo-set material can be properly cooled.

With respect now to FIG. 4B, a puller station 342 is shown, where the puller station would include gripping members to pull the structural member 4 therethrough, which would also pull the fibers through the resin bath and through the heated die. At the same time, the pulling station 342 feeds the completed structural component 4 into the co-extrusion process 302.

A compact compounder 350 used to prepare and extrude the composite material of the present invention, and can be one as manufactured by Pomini, Inc. of Brecksville, Ohio. Compounder 350 includes hoppers 352, mixing station 354 and single screw extruder 356. Hoppers 352A, 352B hold polyethylene and the crumb rubber, respectively, which is fed into mixing stations 354A and 354B. Single screw extruder 356 includes plasticating supply screw 358 as is commonly employed in the extrusion process. Single screw extruder 356 is in flow communication with discharge orifice 360. Plasticating supply screw 358 is mounted within chamber 362, and is driven by a motor. Discharge die 370 is mounted to discharge orifice 360 and is sized to match the desired cross-sectional dimensions of the co-extruded tubular member, in order that the deformable material 6, 106, 206 is deposited on the outer surface of the tubular member 4, 104, or 204, as described more fully below.

Shredded plastic material 380 and crumb rubber 382 are fed from hoppers 352A, 352B into mixer 354 and mixed under pressure. A small amount of dye 444 may also be fed into the mix from an additional hopper (not shown) to provide a wood-simulated color. The extruder 356 drives supply screw 358, which urges the molten composite material under pressure towards outlet end 360 and into cross-head die 370.

As shown in FIG. 6, cross head die 370 is shown in cross-section, when the cross-head die would receive the elongate structural member 4, 104 or 204 and thereafter, the deformable material 6, 106 or 206 would be molded (or co-extruded) onto the exterior surface of the member 4, 104 or 204. As shown in FIG. 6, the cross head die would include a cavity 372, which is diametrically profiled to match the desired profile of the outer deformable member 6. Thus, as shown in FIG. 6, the product that exits the cross-head die 370 is the completed composite tubular member 2, which need only be cooled and cut in length for completion.

Thus, as shown in FIGS. 4B and 4C, the composite structure 2 is pulled through a cooling bath 380 by a second pulling station 382. As mentioned above, the pulling station 382 would grip the member 2, pulling it through the extrusion die 370 and through the cooling bath 380 and would thereafter feed the composite structure 2 to a cutting station 384. The cutting station 384 includes a saw 386, which is longitudinally movable from the position shown at $x_1$ to the position shown at $x_2$. This saw would index with the movement of the finished structure 2 at the same speed as the movement of the pulling stations 342, 382. When the saw is at the position of $x_2$, the finished product 2 would be completely cut and the saw 386 would index back to the position shown at position $x_1$, where it waits for the proper length of material to pass for the next cutting cycle. The finished product is thereafter positioned on a finished stand 390, which could be used for loading or separating into shipments or for warehousing purposes.

Thus, the design depicted herein provides a solution to the needs of the wooden utility pole. The pole can be easily manufactured as mentioned above via the pultrusion process, and can be manufactured easily. The deformable material is made from scrap material as discussed above. The member can be easily stored, and are lighter in weight than wooden poles. When the poles reach their destination, concrete is pumped into the poles to complete their structure. As also mentioned above, an elongate passageway can be formed for the wires to pass through. The deformable material also allows the spikes on the boots of the utility worker to "dig in" to the pole and for the worker to climb the pole. Ultimately, the composite pole shown herein satisfies all the needs of the marketplace.

The invention claimed is:

1. An elongate composite pole, or the like, comprising:

a structural elongate member having an outer tubular member, defining an elongate closed area;

a strengthening material substantially filling said elongate closed area; and an outer casing, comprised of a deformable composite material, deposited on the outside of said outer tubular member, wherein said outer casing is comprised of a composite material of 40%-60% by volume polyethylene and 60%-40% by volume ground rubber particles.

2. The elongate composite pole of claim 1, wherein said structural elongate member further comprises an inner web of strengthening members, defining a plurality of elongate closed columnar areas.

3. The elongate composite pole of claim 2, wherein said outer tubular member is cylindrical.

4. The elongate composite pole of claim 3, wherein said strengthening members are defined as radially extending ribs.

5. The elongate composite pole of claim 4, wherein said structural elongate member is comprised of two substantially concentric cylindrical members interconnected by, said radially extending fins.

6. The elongate composite pole of claim 5, wherein the volume within an inner one of said two substantially concentric cylindrical members is left unfilled for a wiring passageway.

7. The elongate composite pole of claim 6, wherein said strengthening material is concrete.

8. The elongate composite pole of claim 4, wherein said radially extending ribs of said structural elongate member are connected at their diametrical center, forming three substantially equal sectors.

9. The elongate composite pole of claim 8, wherein all of said sectors are filled with said strengthening material.

10. The elongate composite pole of claim 9, wherein said strengthening material is concrete.

11. An elongate composite pole, or the like, comprising:

a structural elongate member having an outer tubular member, and an inner web of strengthening members defining a plurality of elongate closed columnar areas;

a strengthening material substantially filling at least some of said closed columnar areas; and an outer casing deposited on the outside of said outer tubular member, wherein said outer casing is comprised of a composite material of 40%-60% by volume polyethylene and 60%-40% by volume ground rubber particles.

12. The elongate composite pole of claim 11, wherein said outer tubular member is cylindrical.

13. The elongate composite pole of claim 12, wherein said strengthening members are defined as radially extending ribs.

14. The elongate composite pole of claim 13, wherein said structural elongate member is comprised of two substantially concentric cylindrical members interconnected by, said radially extending fins.

15. The elongate composite pole of claim 14, wherein the volume within an inner one of said two substantially concentric cylindrical members is left unfilled for a wiring passageway.

16. The elongate composite pole of claim 15, wherein said strengthening material is concrete.

17. The elongate composite pole of claim 13, wherein said radially extending ribs of said structural elongate member are connected at their diametrical center, forming three substantially equal sectors.

18. The elongate composite pole of claim 17, wherein all of said sectors are filled with said strengthening material.

19. The elongate composite pole of claim 18, wherein said strengthening material is concrete.

20. The elongate composite pole of claim 11, wherein the outer casing is comprised of a deformable composite material.

* * * * *